US006701654B2

(12) United States Patent
Rappaport et al.

(10) Patent No.: US 6,701,654 B2
(45) Date of Patent: Mar. 9, 2004

(54) PERSONALIZED PICTURE POSTCARD FOR HOLDING INSERTED PHOTOGRAPH

(75) Inventors: Jon D. Rappaport, Golden Valley, MN (US); Michael Gregory, Auckland (NZ)

(73) Assignee: Sunshine Girl Creations Inc., Golden Valley, MN (US)

( * ) Notice: Subject to any disclaimer, the term of this patent is extended or adjusted under 35 U.S.C. 154(b) by 50 days.

(21) Appl. No.: 09/792,329

(22) Filed: Feb. 23, 2001

(65) Prior Publication Data

US 2002/0116854 A1 Aug. 29, 2002

(51) Int. Cl.[7] ..... G09F 1/02; B42D 15/04

(52) U.S. Cl. ..... 40/776; 229/92.8; 229/71; 40/654.01

(58) Field of Search ..... 40/776, 775, 771, 40/661, 654.01; 229/92.8, 71

(56) References Cited

U.S. PATENT DOCUMENTS

| | | | | |
|---|---|---|---|---|
| 3,762,630 A | * | 10/1973 | Braznell | 229/92.8 |
| 3,899,127 A | * | 8/1975 | Melander | 229/92.8 |
| 4,008,852 A | | 2/1977 | Davis | |
| 4,070,774 A | | 1/1978 | Staats | |
| 4,183,554 A | | 1/1980 | Howard | |
| 4,231,833 A | | 11/1980 | Lieberman | |
| 4,741,119 A | * | 5/1988 | Baryla | 40/594 |
| 4,914,842 A | | 4/1990 | Lieberman | |
| 5,543,010 A | | 8/1996 | Keng | |
| 5,678,756 A | | 10/1997 | Sugiura | |
| 5,833,129 A | | 11/1998 | Smith | |
| 6,260,886 B1 | | 7/2001 | Hollingbery | |

FOREIGN PATENT DOCUMENTS

| | | | | |
|---|---|---|---|---|
| DE | 295 09 452 U1 | * | 11/1995 | B42D/15/02 |
| EP | 0 924 139 A1 | * | 6/1999 | B65D/27/04 |
| WO | WO 92/20528 | * | 11/1992 | B42D/15/04 |

* cited by examiner

*Primary Examiner*—Cassandra H. Davis
(74) *Attorney, Agent, or Firm*—James V. Harmon

(57) ABSTRACT

A personalized picture postcard for holding inserted photographs includes a backing sheet of a rectangular shape that has an exposed lower surface provided with printed indicia indicating the location of a mailing address and a position for writing a message to the recipient, a rectangular transparent window sheet adhesively bonded to an upper surface of the backing sheet along three aligned side edges to define an envelope therebetween that is open on one end. The backing sheet has a strip of pressure-sensitive adhesive extending along the remaining edge i.e., the free edge thereof. A removable cover strip or liner is releasably secured over the pressure-sensitive adhesive strip to define an open end into which a photo can be inserted by the user. A rectangular border is bonded to the postcard for framing the inserted photo. The border is aligned with the side and end edges of the postcard over the adhesive so as to obscure the adhesive and thus provide an attractive appearance.

6 Claims, 3 Drawing Sheets

PERSONALIZED PICTURE POSTCARD FOR HOLDING INSERTED PHOTOGRAPH

FIELD OF THE INVENTION

This invention relates to postcards and more particularly to a postcard that is personalized with a picture supplied by the user.

BACKGROUND OF THE INVENTION

Various envelopes such as window envelopes have been previously proposed for various applications. These envelopes are provided with glued edges, but there is no provision for enabling the end user to seal the envelope without taking additional steps such as licking the flap to moisten the adhesive on the flap. In order to be commercially acceptable for use with a personal photograph it is necessary to find a way of hiding the glue located at the edges of the postcard while simultaneously embellishing the product to enhance its visual appeal. If the postcard is to have the proper feel and stiffness it is desirable to provide a backing sheet having a degree of stiffness and yet find a way of enabling a photo to be mounted in place and the postcard to be easily sealed in spite of stiffness of the backing used in the construction of the postcard. More specifically, during the development of the present invention it was found desirable to find a way of providing access to a self-sealing strip so that it could be easily uncovered for enabling an inserted picture to be totally enclosed by bonding the self-sealing strip to an adjacent surface of the postcard.

One prior postcard product described in U.S. Pat. Nos. 4,231,833 and 4,914,842 had an adhesive applied to the entire surface of a transparent backing sheet with a protective sheet positioned over it. The entire width and breadth of the postcard was covered with pressure-sensitive adhesive. In addition to the expense of the adhesive, the assembly was complicated. It was necessary to peel a clear backing from a border element, press the product firmly over a photograph, cut around the edges with scissors, next peel the postcard from the adhesive backing and finally place it on the back of the product.

In view of these and other deficiencies of the prior art, it is one object of present invention to provide an improved personalized postcard for holding an inserted photograph that is relatively low in cost, durable in construction and easier to use than prior products.

Another object is to provide a personalized postcard of the type described that can be formed from sheet material with a degree of stiffness and yet enable a self-sealing adhesive surface to be readily exposed and easily uncovered so that a seal can be formed.

Another object of the invention is to find a better, more effective way of surrounding or framing the photograph as well as hiding adhesive that is used to bond the sheets together.

Another object of the invention is to find a way of designing the unit so that the method of use is generally obvious to the user while at the same time minimizing the amount of pressure-sensitive adhesive that is required in its construction.

These and other more detailed object and specific objects of the present invention will be better understood by reference to the following figures and detailed description which illustrate by way of example but a few of the various forms of the invention within the scope of the appended claims.

THE FIGURES

SUMMARY OF THE INVENTION

The invention provides a personalized picture postcard for holding inserted photographs that includes a backing sheet of a rectangular shape that has an exposed lower surface provided with printed indicia indicating the location of a mailing address and a position for writing a message to the recipient, a rectangular transparent window sheet adhesively bonded to an upper surface of the backing sheet along three aligned side edges to define an envelope therebetween that is open on one end. The backing sheet has a strip of pressure-sensitive adhesive extending along the remaining edge i.e., the free edge thereof. A removable cover strip or liner is releasable secured over the pressure-sensitive adhesive strip to define an open end into which a photo can be inserted by the user. A rectangular border is bonded to the postcard for framing the inserted photo. The border is aligned with the side and end edges of the postcard over the adhesive so as to obscure the adhesive and thus provide an attractive appearance.

DETAILED DESCRIPTION OF THE INVENTION

Figure 1:
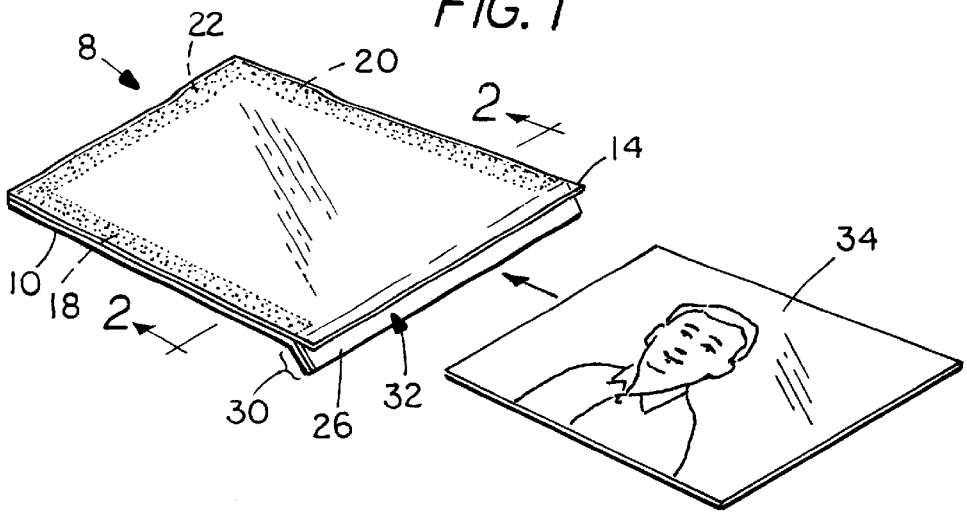
FIG. 1 is a perspective view of the invention shown just before a photograph is inserted into one end thereof.
Figure 2:
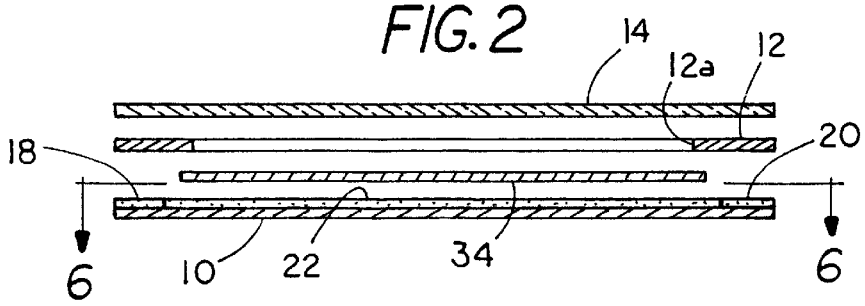
FIG. 2 is a transverse exploded cross sectional view taken on line 2–2 of FIG. 1. on a larger scale.
Figure 1A:
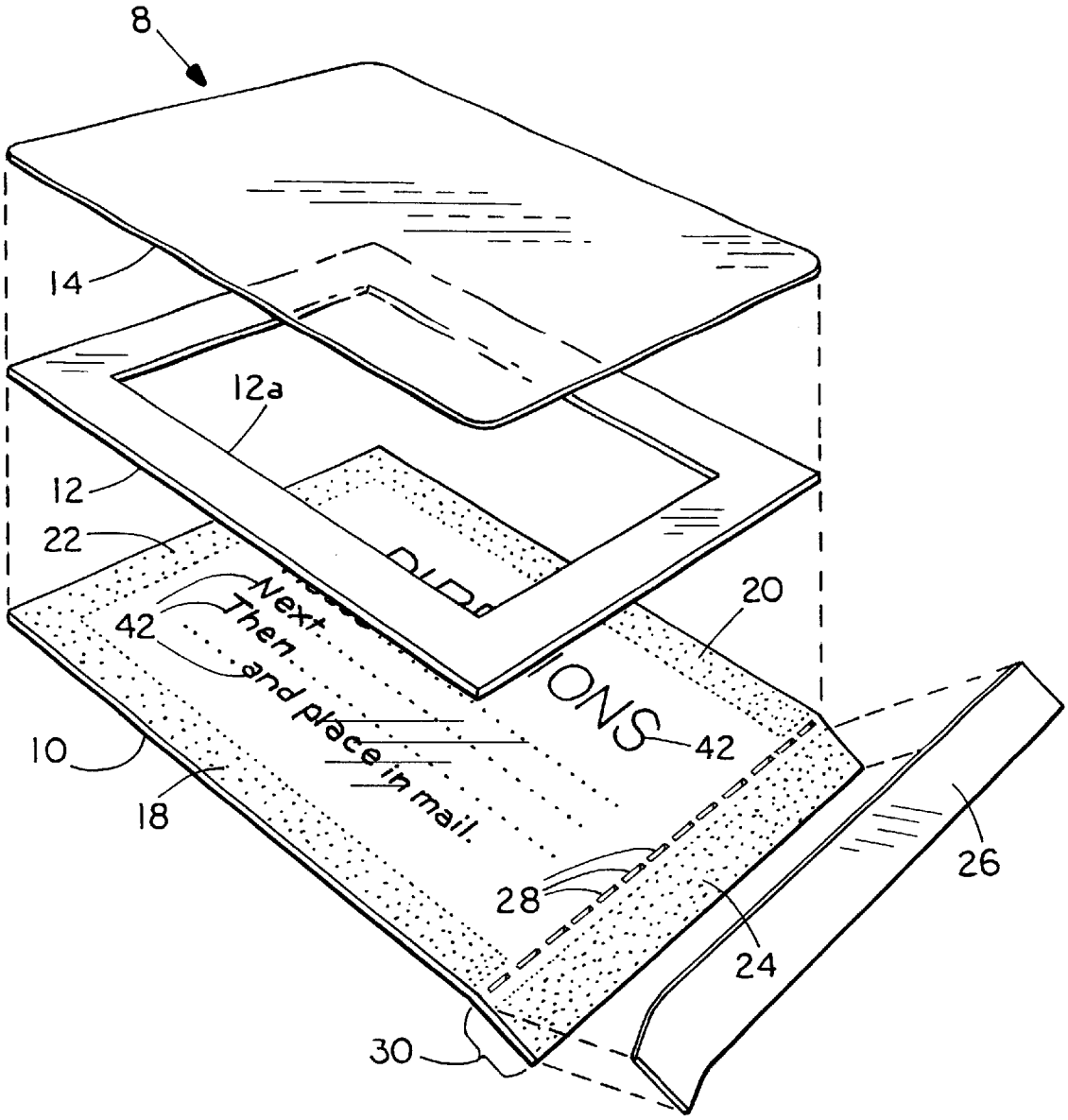
FIG. 1A is an exploded perspective view on a larger scale than in FIG. 1.

Referring now to the drawings and especially to FIGS. 1, 1A and 2 it will be seen that the postcard 8 is a composite or laminate formed from three major components namely a backing sheet 10 a border 12 for framing the picture and a transparent window sheet 14 that can comprise a sheet of plastic such as a sheet of 10 mil. transparent polyvinyl chloride plastic which is self-supporting and has a certain degree of stiffness. By "self-supporting" we mean that it will stand up straight when held at one end. The backing 10 preferably comprises of a sheet of heavy paper or light paperboard e.g., 30 lb. white sulfite paper. The sheets 10, 14 and the border 12 can be about six and a half inches long by four and five eighths inches wide for accepting a four inch by six inch photograph. Other sizes can be provided to accommodate photographs of different sizes. The border 12 can be of any color or design for framing the picture and includes four segments that are aligned with the edges of the postcard 8. The border of FIGS. 1A and 2 is printed and comprises layers of printing ink applied to the lower surface of the window sheet 14. It can be printed on either the upper or lower surface as desired but is preferably printed on the lower surface because it will then be protected and cannot be damaged or wear off. If desired, the border 12 can also comprise a separate layer of sheet material. such as a thin layer of colored paper or plastic having an open center 12*a*. The border is typically about one half inch in width from its outer edge to the open center 12*a*.

The sheets 10 and 14 are bonded together by means of adhesive strips 18 and 20 running along opposite side edges and an end strip 22 of adhesive which extends along the end edge furthest from the observer in FIGS. 1 and 1A. For clarity of illustration, the border 12 has been shown only in FIGS. 1A and 2.

A pressure-sensitive adhesive strip 24 extends along an edge of the backing 10 opposite the strip 22. However, the pressure-sensitive adhesive strip 24 is covered by means of a removable liner or cover strip 26 which is shown partially pealed back in FIG. 4 at 26*a* so as to expose the self-sealing pressure-sensitive adhesive strip 24 when a bond is to be formed. Adjacent to the strip 24 and spaced somewhat inwardly a row of perforations 28 parallel to strip 24 that define a fold line for a flap 30 which hangs down somewhat or can be easily pushed down to an inclined position as shown in the Figures. The inclined flap 30 exposes an opening or mouth 32 between the sheets 10 and 14 (FIG. 1) into which a photograph 34 that is supplied by the user, and itself forms no part of the invention, can be easily inserted into place between the sheets 10 and 14. Once inserted, the photograph 34 will be nicely framed by the border 12 which also hides the adhesive strips 18–24.

Figure 4:
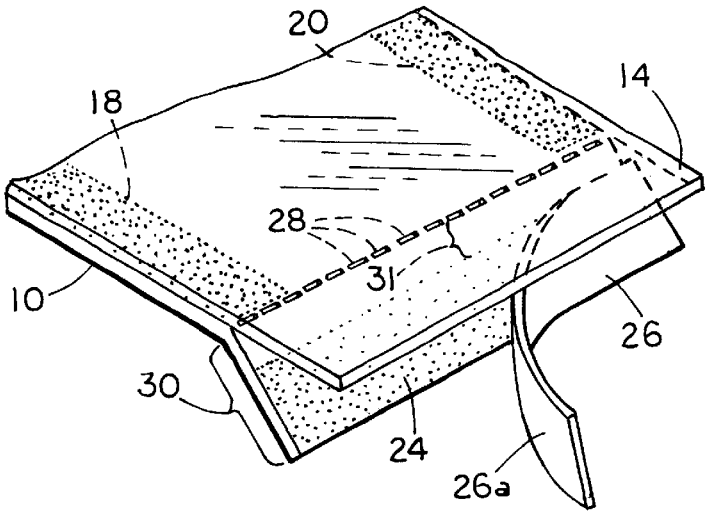
FIG. 4 is a view similar to FIG. 3 showing the cover strip partially removed.
Figure 5:
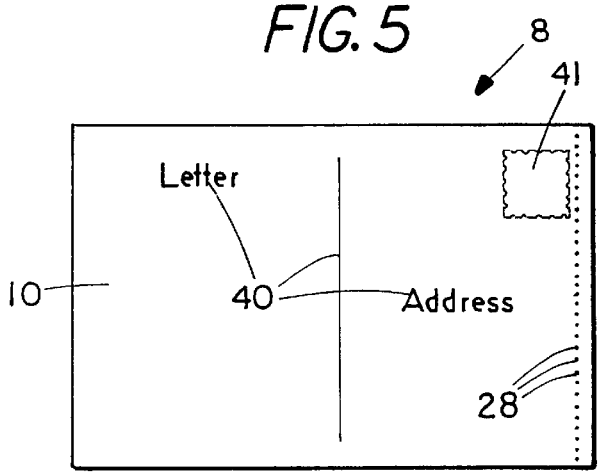
FIG. 5 is a bottom plan view of the invention.
Figure 6:
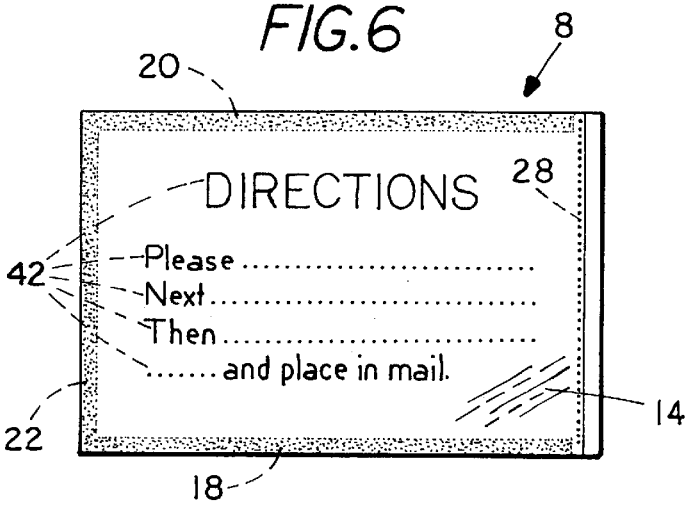
FIG. 6 is a top plan view of the invention.

While a fold line can be formed by embossing or scoring, it is preferred to form the fold line by means of the perforations or punched openings 28 to enable the flap 30 to bend more easily to the open position shown in FIG. 1 so that the mouth 32 is easily exposed to receive the photograph 34. Once the photograph 34 is inserted completely, the removable liner 26 is pulled off as shown in FIG. 4 and discarded. The self-sealing pressure-sensitive adhesive strip 24 is then pressed against the opposed confronting under surface of the window sheet 14 thereby sealing the photograph 34 on all sides within the postcard 8.

As already noted, the lower surface of the backing sheet 10 is provided with printed indicia 40 for indicating a place for writing an address and message to the recipient of the postcard. The printed indicia 40 can comprise the words, "letter" and "address" with a vertical line indicating a separation between the two. The indicia 40 can also provide a location 41 for a postage stamp if desired.

The upper surface of the backing sheet 10 is printed with a second set of indicia 42 comprising directions for use. These directions can easily be seen since they are clearly visible through the plastic window sheet 14 when the postcard is about to be used but will be covered by the inserted photograph when no longer needed. The indicia 42 consists of instructions for lifting and bending back the flap 30 and inserting a photograph. The user is also instructed to remove the peel-off strip or liner 26 as shown in FIG. 4 and press the adhesive 24 against the lower surface of the window sheet 14 to seal the photograph 34 on all sides within the postcard 8.

Figure 3:
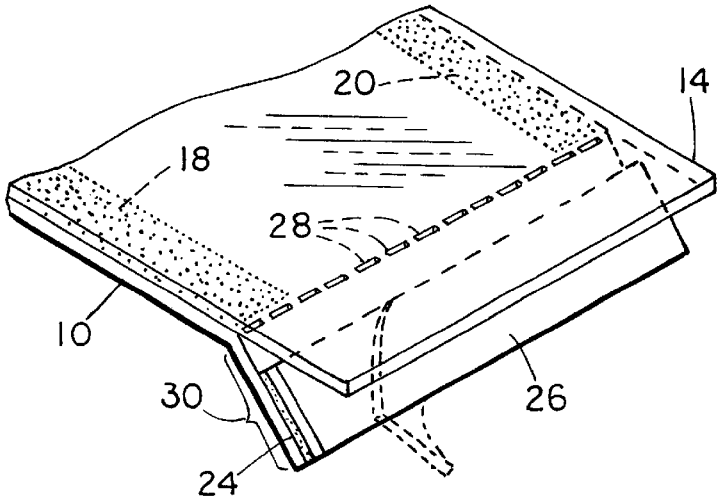
FIG. 3 is a partial perspective view of the invention showing an adhesive liner or cover strip before it is removed.

It can be seen that a gap 31 (FIGS. 3 and 4) devoid of adhesive is provided between the adhesive strip 24 and the fold line defined by the perforations 28 so that even if a person inserts a photograph after the liner 26 has been removed it, will not jam by becoming stuck to the adhesive strip 24.

It was found that the invention is durable, rugged in construction, can be manufactured at relatively low cost partly because adhesive is required only at the edges. Moreover it is highly effective in protecting photographs during transport in the mail. In addition the mouth of the postcard 32 where the photo is to be inserted opens easily and conveniently for enabling the user to quickly insert the photograph with a minimum of manipulation. In addition, the invention is very easy to use since it requires only that the photograph be inserted, the liner strip be removed and the seal formed between the adhesive strip 24 and the opposed confronting surface of the window sheet 14.

Many variations of the present invention within the scope of the appended claims will be apparent to those skilled in the art once the principles described herein are understood.

What is claimed is:

1. A personalized picture postcard for holding an inserted photograph comprising, a backing sheet of rectangular shape having an upper surface and a lower surface, printed indicia on the lower surface of the backing sheet for designating the location of an address and a message to the recipient of the postcard, a transparent rectangular window sheet adhesively bonded to corresponding aligned edges of the backing sheet on three edges thereof to define an envelope that is open at one end thereof for receiving a photograph supplied by the user and, a sealing strip for forming an adhesive bond between the backing sheet and the window sheet at said open end thereof to enclose said inserted photograph on all sides thereof within said postcard, the backing sheet has a pair of opposed end edges and a pair of opposed side edges, an adhesive is applied to a pair of opposed side edges and one end edge and the sealing strip is applied along a remaining end edge, a removable cover strip is applied over the sealing strip, a fold line is positioned to extend adjacent said sealing strip and parallel thereto for defining a flap that can be folded away from the transparent window sheet to form a mouth adapted for receiving the inserted photograph supplied by the user between the window sheet and the backing sheet, and the fold line composes a row of perforations through the backing sheet.

2. The postcard of claim 1 wherein a second of is printed upon the upper surface of the backing sheet so as to be visible through the transparent window sheet, said second set of indicia provides directions for the use of the invention including instructions for the picture postcard of photograph therewithin and for sealing the sealing strip to an opposed surface to enclose the photograph on all sides within the postcard.

3. The postcard of claim 1 wherein a border is printed on the postcard.

4. A personalized picture postcard for holding an inserted photograph comprising, a backing sheet of rectangular shape having an upper surface and a lower surface, printed indicia on the lower surface of the backing sheet for designating the location of an address and a message to the recipient of the postcard, a transparent rectangular window sheet adhesively bonded to corresponding aligned edges of the backing sheet on three edges thereof to define an envelope that is open at one end thereof for receiving a photograph supplied by the user and, a sealing strip for forming an adhesive bond between the backing sheet and the window sheet at said open end thereof to enclose said inserted photograph on all sides thereof within said postcard, the backing sheet has a pair of opposed end edges and a pair of opposed side edges, an adhesive is applied to a pair of opposed side edges and one end edge and the sealing strip is applied along a remaining end edge, a removable cover strip is applied over the sealing strip, a fold line is positioned to extend adjacent said sealing strip and parallel thereto for defining a flap that can be folded away from the transparent window sheet to form a mouth adapted for receiving the inserted photograph supplied by the user between the window sheet and the backing sheet, and a gap devoid of adhesive is provided between the sealing strip and the fold line to facilitate insertion of the photograph into the postcard.

5. The postcard of claim 4 wherein a border is printed upon the lower surface of the transparent window sheet.

6. The postcard of claim 4 wherein a second set of indicia is printed upon the upper surface of the backing sheet so as to be visible through the transparent window sheet, said second set of indicia provides directions for the use of the invention including instructions for the insertion of a photograph therewithin and for bonding the sealing strip to an opposed surface to enclose the photograph on all sides within the postcard and a border is provided on the postcard.

* * * * *

UNITED STATES PATENT AND TRADEMARK OFFICE

CERTIFICATE OF CORRECTION

PATENT NO. : 6,701,654 B2
DATED : March 9, 2004
INVENTOR(S) : Jon Rappaport et al.

It is certified that error appears in the above-identified patent and that said Letters Patent is hereby corrected as shown below:

Column 4,
Line 31, before "is" cancel "of" and insert -- set of indicia --
Line 35, cancel "picture postcard of" and insert -- insertion of a --

Signed and Sealed this

First Day of June, 2004

JON W. DUDAS
*Acting Director of the United States Patent and Trademark Office*